US011813714B2

(12) United States Patent
Kim et al.

(10) Patent No.: US 11,813,714 B2
(45) Date of Patent: Nov. 14, 2023

(54) CHEMICAL MECHANICAL POLISHING PAD AND CHEMICAL MECHANICAL POLISHING APPARATUS INCLUDING THE SAME

(71) Applicant: SAMSUNG ELECTRONICS CO., LTD., Suwon-si (KR)

(72) Inventors: Hojoong Kim, Yongin-si (KR); Taesung Kim, Seoul (KR); Seokjun Hong, Siheung-si (KR); Junyong Kim, Yongin-si (KR); Donghyuk Jang, Seongnam-si (KR); Youngjin Hong, Hwaseong-si (KR)

(73) Assignees: SAMSUNG ELECTRONICS CO., LTD., Suwon-si (KR); Research & Business Foundation SUNGKYUNKWAN UNIVERSITY, Suwon-si (KR)

( * ) Notice: Subject to any disclaimer, the term of this patent is extended or adjusted under 35 U.S.C. 154(b) by 429 days.

(21) Appl. No.: 17/026,554

(22) Filed: Sep. 21, 2020

(65) Prior Publication Data

US 2021/0283744 A1 Sep. 16, 2021

(30) Foreign Application Priority Data

Mar. 13, 2020 (KR) ..... 10-2020-0031290

(51) Int. Cl.
*B24B 37/26* (2012.01)

(52) U.S. Cl.
CPC ..... *B24B 37/26* (2013.01)

(58) Field of Classification Search
CPC ..... B24B 37/26; B24B 37/16; B24B 37/14; B24B 37/12; B24B 37/11; B24B 37/245;
(Continued)

(56) References Cited

U.S. PATENT DOCUMENTS 6,159,088 A * 12/2000 Nakajima ..... B24B 37/26 451/550
6,572,439 B1 * 6/2003 Drill ..... B24B 37/20 451/63

(Continued)

FOREIGN PATENT DOCUMENTS

CN 108994723 A 12/2018
CN 110802508 A * 2/2020 ..... B24B 37/26

(Continued)

OTHER PUBLICATIONS

Translation of CN-110802508-A (Year: 2020).*
Translation of KR-2007022054-A (Year: 2007).*

*Primary Examiner* — Brian D Keller
*Assistant Examiner* — Steven Huang
(74) *Attorney, Agent, or Firm* — Lee IP Law, P.C.

(57) ABSTRACT

A chemical mechanical polishing (CMP) apparatus and a CMP pad, the apparatus including a rotating plate; a CMP pad on an upper surface of the rotating plate; a rotating body facing the rotating plate and bringing a wafer into contact with the CMP pad to press the wafer; and a slurry supply configured to supply slurry to the CMP pad, wherein the CMP pad includes a pad body having a circular plate shape; a plurality of circular grooves on a bottom surface of the pad body, the plurality of circular grooves having a circular shape; and a connection groove connecting the plurality of circular grooves, the connection groove having a linear shape.

6 Claims, 8 Drawing Sheets

(58) Field of Classification Search
CPC ..... B24B 37/24; B24B 37/22; B24B 37/205; B24B 37/20; B24D 11/00
USPC ..... 451/527
See application file for complete search history.

(56) References Cited

U.S. PATENT DOCUMENTS

| | | | | |
|---|---|---|---|---|
| 7,070,480 | B2 | 7/2006 | Moon et al. | |
| 7,377,840 | B2 | 5/2008 | Deopura et al. | |
| 8,398,461 | B2 | 3/2013 | Wang | |
| 9,211,628 | B2 | 12/2015 | Allison et al. | |
| 9,375,823 | B2 | 6/2016 | Kerprich et al. | |
| 9,409,276 | B2 | 8/2016 | Tsai et al. | |
| 9,649,742 | B2 | 5/2017 | Lefevre et al. | |
| 2002/0068516 | A1 | 6/2002 | Chen et al. | |
| 2006/0019587 | A1* | 1/2006 | Deopura | B24B 37/26 451/526 |
| 2006/0154574 | A1* | 7/2006 | Elmufdi | B24B 37/26 451/41 |
| 2011/0014853 | A1* | 1/2011 | Wang | B24B 37/26 451/28 |
| 2015/0004889 | A1 | 1/2015 | Seth | |
| 2016/0023322 | A1* | 1/2016 | Allison | B24D 11/001 51/296 |
| 2016/0101501 | A1 | 4/2016 | Schutte et al. | |
| 2017/0274496 | A1 | 9/2017 | Cook et al. | |
| 2018/0354094 | A1 | 12/2018 | Qian et al. | |
| 2018/0361532 | A1 | 12/2018 | Nguyen et al. | |
| 2018/0361533 | A1 | 12/2018 | Nguyen et al. | |
| 2018/0366331 | A1 | 12/2018 | Nguyen et al. | |
| 2018/0366332 | A1 | 12/2018 | Nguyen et al. | |
| 2018/0366333 | A1 | 12/2018 | Nguyen et al. | |
| 2019/0105753 | A1 | 4/2019 | Dan et al. | |

FOREIGN PATENT DOCUMENTS

| | | | | |
|---|---|---|---|---|
| JP | 2003-209077 | A | 7/2003 | |
| JP | 2005-183708 | A | 7/2005 | |
| JP | 2005-294412 | A | 10/2005 | |
| KR | 2007022054 | A * | 2/2007 | B24B 37/26 |

* cited by examiner

CHEMICAL MECHANICAL POLISHING PAD AND CHEMICAL MECHANICAL POLISHING APPARATUS INCLUDING THE SAME

CROSS-REFERENCE TO RELATED APPLICATION

Korean Patent Application No. 10-2020-0031290, filed on Mar. 13, 2020, in the Korean Intellectual Property Office, and entitled: "CMP Pad and Chemical Mechanical Polishing Apparatus Having the Same," is incorporated by reference herein in its entirety.

BACKGROUND

1. Field

Embodiments relate to a chemical mechanical polishing pad and a chemical mechanical polishing apparatus including the same.

2. Description of the Related Art

A chemical mechanical polishing (CMP) process may be undertaken using a CMP apparatus to planarize a wafer when semiconductor devices are manufactured. The CMP process may be a process of polishing a surface of the wafer by using a chemical mechanical interaction between the wafer and the CMP pad.

SUMMARY

The embodiments may be realized by providing a chemical mechanical polishing (CMP) apparatus including a rotating plate; a CMP pad on an upper surface of the rotating plate; a rotating body facing the rotating plate and bringing a wafer into contact with the CMP pad to press the wafer; and a slurry supply configured to supply slurry to the CMP pad, wherein the CMP pad includes a pad body having a circular plate shape; a plurality of circular grooves on a bottom surface of the pad body, the plurality of circular grooves having a circular shape; and a connection groove connecting the plurality of circular grooves, the connection groove having a linear shape.

The embodiments may be realized by providing a chemical mechanical polishing (CMP) pad including a pad body having a circular plate shape; a plurality of circular grooves on a bottom surface of the pad body, the plurality of circular grooves having a circular shape; and a connection groove connecting the plurality of circular grooves, the connection groove having a linear shape.

BRIEF DESCRIPTION OF DRAWINGS

Features will be apparent to those of skill in the art by describing in detail exemplary embodiments with reference to the attached drawings in which.

DETAILED DESCRIPTION

Chemical Mechanical Polishing Apparatus

Figure 1:
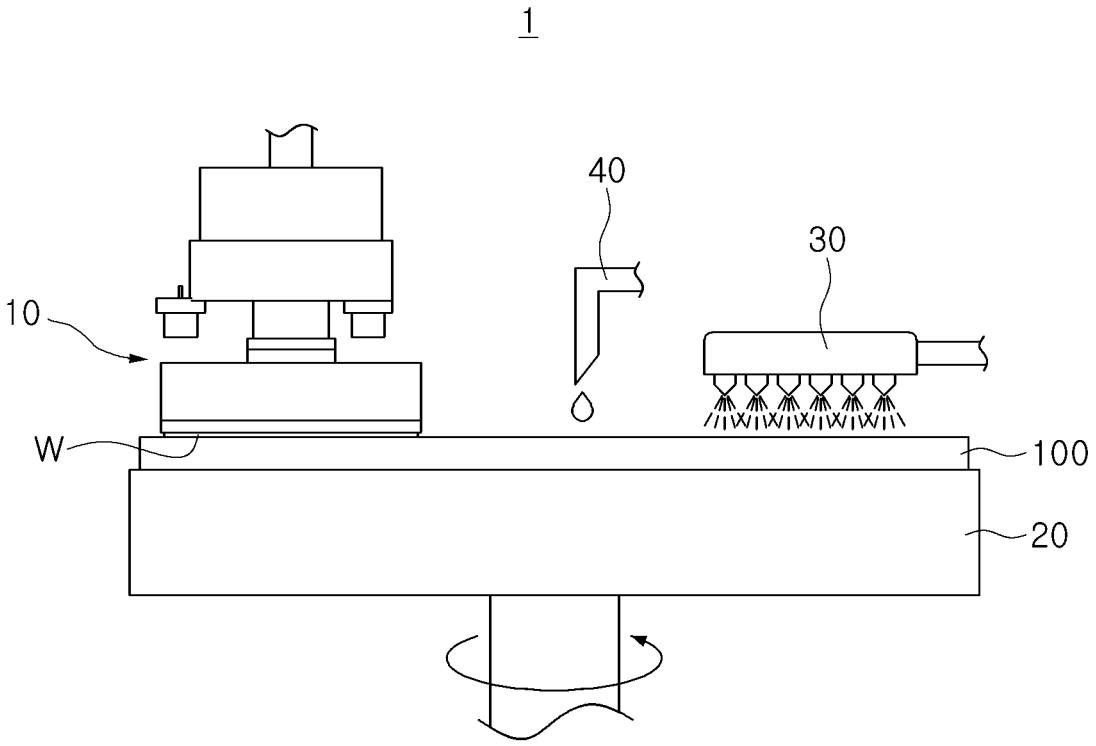
FIG. 1 is a configuration diagram of a chemical mechanical polishing apparatus according to an embodiment.

FIG. 1 is a configuration diagram of a chemical mechanical polishing apparatus according to an example embodiment.

Referring to FIG. 1, a chemical mechanical polishing apparatus 1 may include a rotating body 10 for pressing wafer W, a rotator for rotating the rotating body 10, a CMP pad 100 to which one surface of the wafer W contacts, a rotating plate 20 to which the CMP pad is attached and rotated, and a conditioner for restoring a surface condition of the CMP pad 100.

In an implementation, the chemical mechanical polishing apparatus 1 may further include a CMP pad cleaner 30 for cleaning the CMP pad 100 and a slurry supply 40 for supplying slurry to the CMP pad 100.

As described above, chemical mechanical polishing may be performed while a wafer installed on a bottom surface of the rotating body 10 contacts the CMP pad 100.

The CMP pad 100 and a modified example thereof will be described in detail below.

CMP Pad

Figure 2:
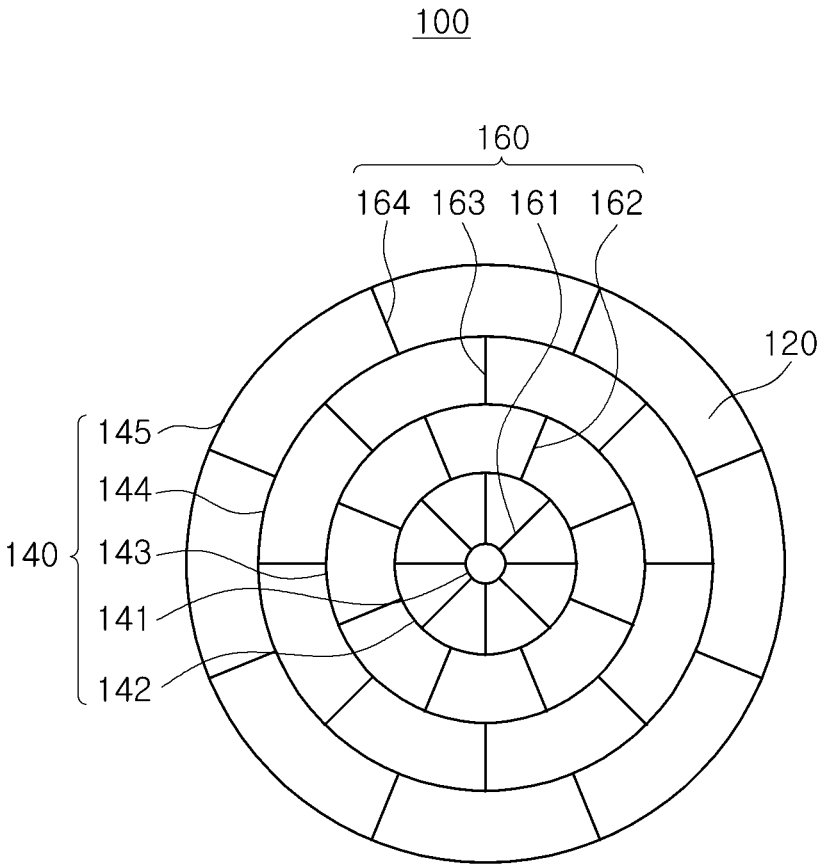
FIG. 2 is a plan view of a CMP pad according to an embodiment.

FIG. 2 is a plan view of a CMP pad according to an example embodiment.

Referring to FIG. 2, the CMP pad 100 may include a pad body 120, a circular groove 140, and a connection groove 160.

The pad body 120 may have a circular plate shape. In an implementation, the pad body 120 may be provided with a polishing layer.

A plurality of the circular grooves 140 may be on the pad body 120. In an implementation, the circular grooves 140 may include a first circular groove 141 having a smallest diameter and in a central portion of the pad body 120, a second circular groove 142 outside of the first circular groove 141 and having a greater diameter than the first circular groove 141, a third circular groove 143 outside of the second circular groove 142 and having a greater diameter than the second circular groove 142, a fourth circular groove 144 outside of the third circular groove 143 and having a greater diameter than the third circular groove 143, and a fifth circular groove 145 at an edge of the pad body 120 and having a largest diameter.

In an implementation, the circular grooves 140 may include the first to fifth circular grooves 141 to 145. In an implementation, the number of circular grooves 140 may be variously changed.

In an implementation, the first to fifth circular grooves 141 to 145 may have the same center of circles, e.g., may be concentric.

In an implementation, the connection groove 160 may include a first connection groove 161 connecting the first circular groove 141 and the second circular groove 142 and having a linear shape, a second connection groove 162 connecting the second circular groove 142 and the third circular groove 143, having a linear shape, and being displaced from (e.g., circumferentially offset, misaligned, or discontinuous with) the first connection groove 161, a third connection groove 163 connecting the third circular groove 143 and the fourth circular groove 144, having a linear shape, and being displaced from the second connection groove 162, and a fourth connection groove 164 connecting the fourth circular groove 144 and the fifth circular groove 145, having a linear shape, and being displaced from the third connection groove 163.

A plurality of the first to fourth connection grooves 161 to 164 may be spaced apart from each other in a circumferential direction.

In an implementation, the third connection groove 163 may be on an extension line of the first connection groove 161 (e.g., the third connection groove 163 may be colinear with or linearly aligned with the first connection groove 161), and the fourth connection groove 164 may be on an extension line of the second connection groove 162.

In an implementation, the extension lines of the first to fourth connection grooves 161 to 164 may pass through a center of circle of the circular groove 140 (e.g., the extension lines of the first to fourth connection grooves 161 to 164 may extend radially relative to a center of the pad body 120). In an implementation, the first to fourth connection grooves 161 to 164 may extend in a normal or radial direction, perpendicular to a tangential line of the circular groove 140. In an implementation, the plurality of first to fourth connection grooves 161 to 164 may be spaced apart from each other in a radial direction.

When defining a term for a direction, a circumferential direction means a direction rotated or extending around an outer circumferential surface of the pad body 120, and a radial direction means that a direction from an edge of the pad body 120 toward a center of the pad body 120 or a direction from the center of the pad body 120 directly outwardly toward the edge of the pad body 120.

As described above, slurry may be spread evenly over an entire region of the CMP pad 100 through the circular groove 140 and the connection groove 160, and the slurry may not be unnecessarily excessively supplied. As described above, there is an effect of improving semiconductor productivity and reducing the slurry due to the supply of improved slurry.

Figure 3:
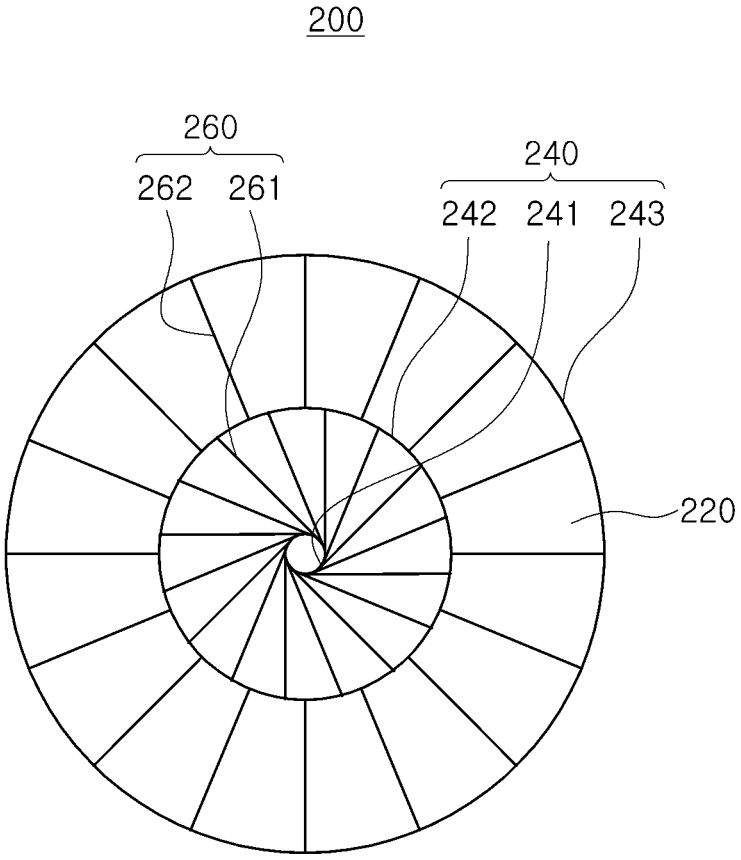
FIG. 3 is a plan view of a modified example embodiment of a CMP pad according to an example embodiment.

FIG. 3 is a plan view of a modified example embodiment of a CMP pad according to an example embodiment.

Referring to FIG. 3, a CMP pad 200 may include a pad body 220, a circular groove 240, and a connection groove 260. The pad body 220 may have a circular plate shape. In an implementation, the pad body 220 may be provided with a polishing layer.

A plurality of the circular grooves 240 may be on the pad body 220. In an implementation, the circular groove 240 may include a first circular groove 241 having the smallest diameter and being in a central portion of the pad body 220, a second circular groove 242 outside of the first circular groove 241 and having a greater diameter than the first circular groove 241, and a third circular groove 243 at an edge of the pad body 220 and having a greatest diameter.

In an implementation, the circular groove 240 may include the first to third circular grooves 241 and 243 or the number of circular grooves 240 may be variously changed.

In an implementation, the first to third circular grooves 241 to 243 may be concentric.

In an implementation, the connection groove 260 may include a first connection groove 261 connecting the first circular groove 241 and the second circular groove 242 and having a linear shape, and a second connection groove 262 connecting the second circular groove 242 and the third circular groove 243, having a linear shape, and being displaced from the second connection groove 261.

In an implementation, the first connection groove 261 may extend along a line tangential to the first circular groove 241. In an implementation, the plurality of first connection grooves 261 may be spaced apart from each other in a circumferential direction. The second connection groove 262 may extend radially relative to a center of circle of the circular groove 240. In an implementation, the second connection groove 262 may be disposed in a normal direction, perpendicular to a tangent of the second circular groove 242. In an implementation, the plurality of second connection grooves 262 may also be spaced apart from each other in a circumferential direction.

As described above, the slurry may be spread evenly over an entire region of the CMP pad 200 through the circular groove 240 and the connection groove 260, and the slurry may not be unnecessarily excessively supplied. As such, there is an effect of improving semiconductor productivity and reducing slurry due to the supply of improved slurry.

Figure 4:
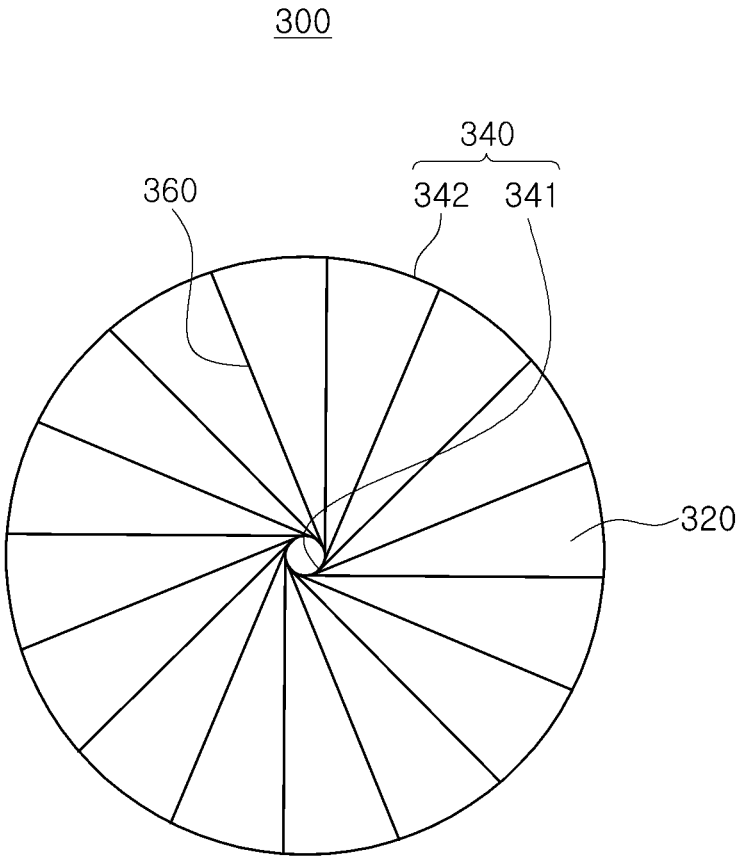
FIG. 4 is a plan view of a modified example embodiment of a CMP pad according to an example embodiment.

FIG. 4 is a plan view of a modified example embodiment of a CMP pad according to an example embodiment.

Referring to FIG. 4, a CMP pad 300 may include a pad body 320, a circular groove 340, and a connection groove 360. The pad body 320 may have a circular plate shape. In an implementation, the pad body 320 may be provided with a polishing layer.

A plurality of circular grooves 340 may be provided on the pad body 320. In an implementation, the circular groove 340 may include a first circular groove 341 in a central portion of the pad body 320 and a second circular groove 342 outside of the first circular groove 341 and at or near an edge of the pad body 320.

In an implementation, the circular groove 340 may include the first to second circular grooves 341 and 342, or the number of circular grooves 340 may be variously changed. In an implementation, the first to second circular grooves 341 and 342 may be concentric.

In an implementation, the connection groove 360 may connect the first circular groove 241 and the second circular groove 242, and may have a linear shape. In an implementation, the connection groove 360 may extend along a line tangent to the first circular groove 341. In an implementation, a plurality of connection grooves 360 may be spaced apart from each other in a circumferential direction.

Figure 5:
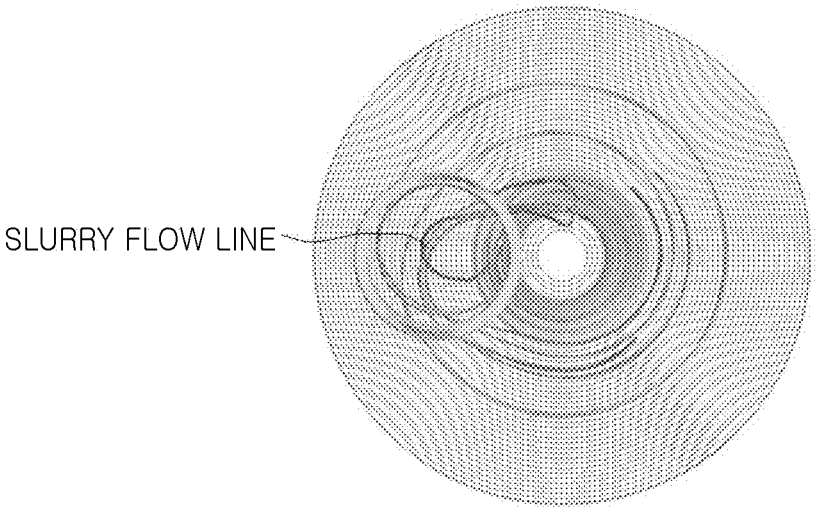
FIGS. 5 and 6 are diagrams of a flow state of a slurry on a comparative CMP pad.
Figure 6:
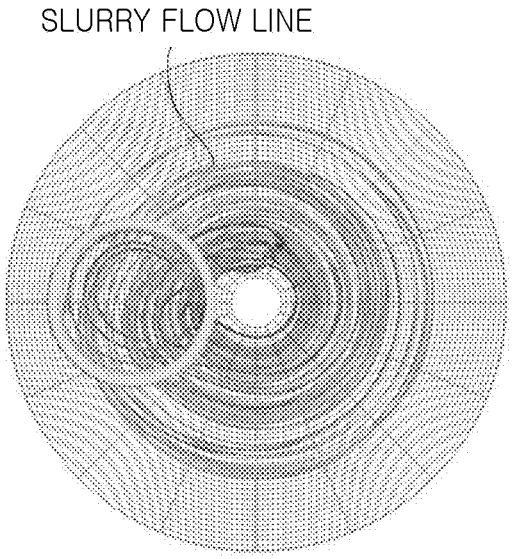
Figure 7:
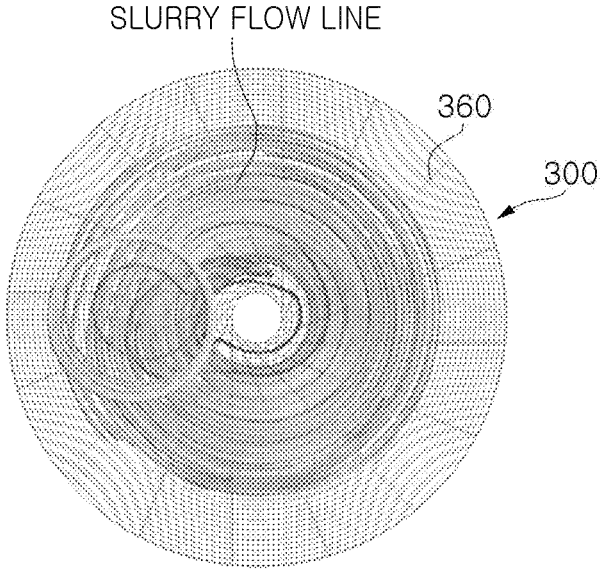
FIG. 7 is a diagram of a flow state of a slurry on the CMP pad illustrated in FIG. 4.

As illustrated in FIG. 7, when the circular groove 340 and the connection groove 360 are provided on the CMP pad 300, it may be seen that a flow of the slurry is improved. That is, it may be seen that the flow of the slurry is improved compared to the comparative CMP pads illustrated in FIGS. 5 and 6.

As described above, the slurry may be spread evenly over an entire region of the CMP pad 300 through the circular groove 340 and the connection groove 360, and the slurry may not be unnecessarily excessively supplied. As such, there is an effect of improving semiconductor productivity and reducing slurry due to the supply of the improved slurry.

Figure 8:
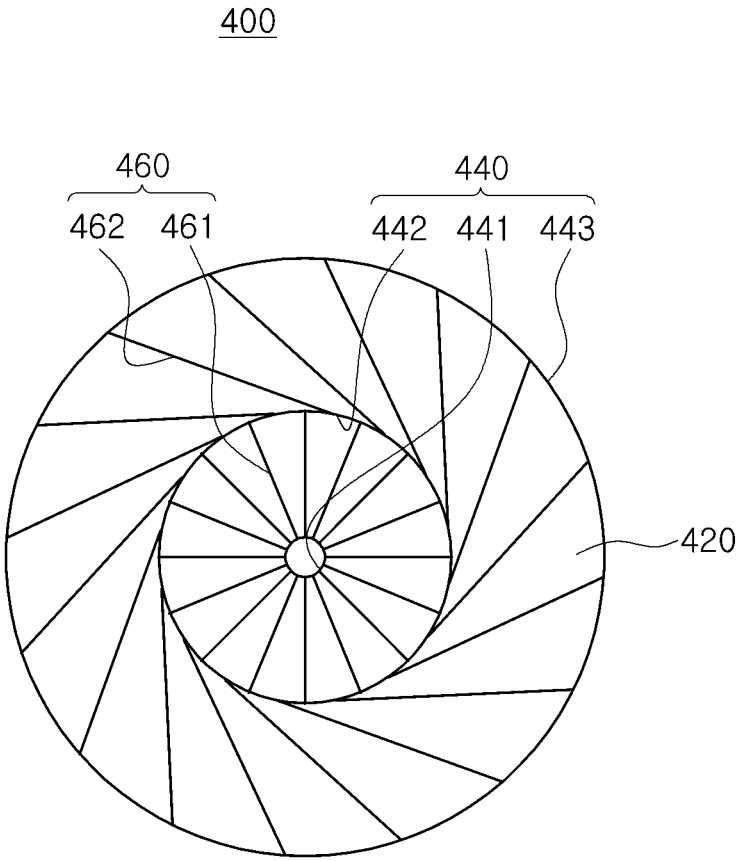
FIG. 8 is a plan view of a modified example embodiment of a CMP pad according to an example embodiment.

FIG. 8 is a plan view of a modified example embodiment of a CMP pad according to an example embodiment.

Referring to FIG. 8, a CMP pad 400 may include a pad body 420, a circular groove 440, and a connection groove 460. The pad body 420 may have a circular plate shape. In an implementation, the pad body 420 may be provided with a polishing layer.

A plurality of the circular grooves 440 may be provided on the pad body 420. In an implementation, the circular groove 440 may include a first circular groove 441 having a smallest diameter and in a central portion of the pad body 420, a second circular groove 442 outside of the first circular groove 441 and having a greater diameter than the first circular groove 441, and a third circular groove 443 at an edge of the pad body 420 and having a greatest diameter.

In an implementation, the circular groove 440 may be provided with the first to third circular grooves 441 to 443, or the number of circular grooves 440 may be variously changed. In an implementation, the first to third circular grooves 441 to 443 may be concentric.

In an implementation, the connection groove 460 may include a first connection groove 461 connecting the first circular groove 441 and the second circular groove 442 and having a linear shape, and a second connection groove 462 connecting the second circular groove 442 and the third circular groove 443, having a linear shape, and displaced from the first connection groove 461.

In an implementation, the first connection groove 461 may extend in a radial direction of the first circular groove 441. In an implementation, the first connection groove 461 may be disposed such that an extension line thereof passes through the center of circle of the circular groove 240. In an implementation, a plurality of the first connection grooves 461 may be spaced apart from each other in a circumferential direction. In an implementation, the second connection groove 462 may extend a long a line tangent to the second circular groove 442. In an implementation, a plurality of the second connection grooves 462 may be spaced apart from each other in a circumferential direction.

As described above, slurry may be spread evenly over an entire region of the CMP pad 400 through the circular groove 440 and the connection groove 460, and the slurry may not be unnecessarily excessively supplied. As described above, there is an effect of improving semiconductor productivity and reducing slurry due to the supply of improved slurry.

Figure 9:
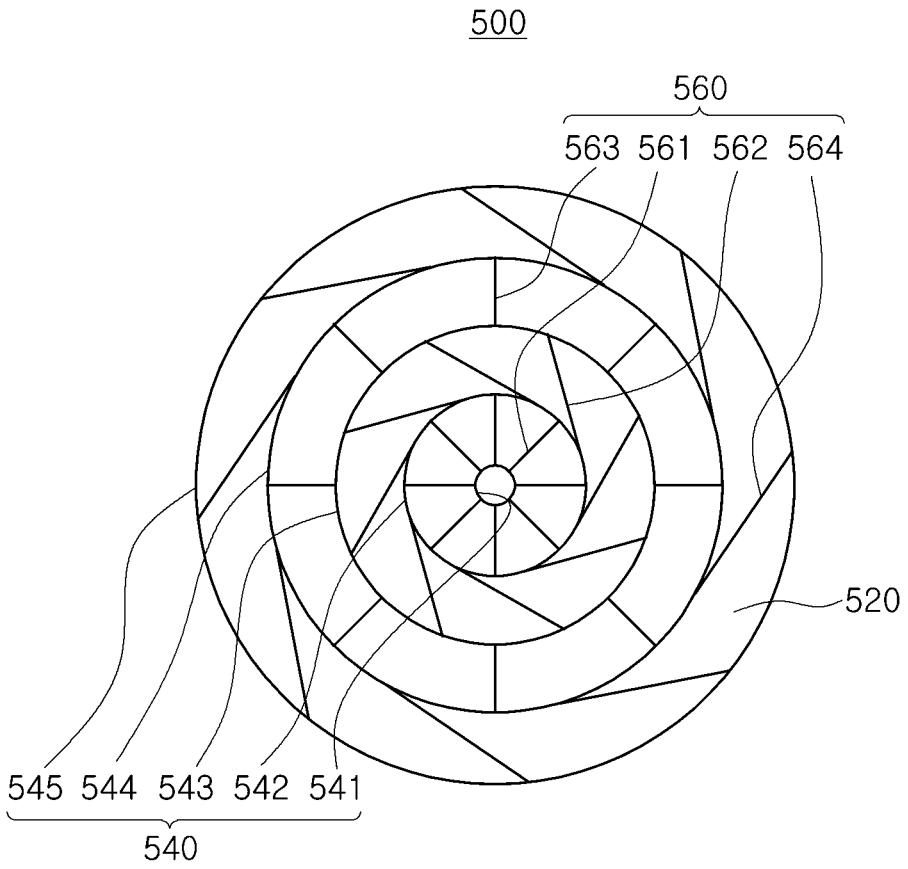
FIG. 9 is a plan view of a modified example embodiment of a CMP pad according to an example embodiment.

FIG. 9 is a plan view of a modified example embodiment of a CMP pad according to an example embodiment.

Referring to FIG. 9, a CMP pad 500 may include a pad body 520, a circular groove 540, and a connection groove 560. The pad body 520 may have a circular plate shape. In an implementation, the pad body 520 may be provided with a polishing layer.

A plurality of circular grooves 540 may be on the pad body 520. In an implementation, the circular groove 540 may include a first circular groove 541 having a smallest diameter and being in a central portion of the pad body 520, a second circular groove 542 outside of the first circular groove 541 and having a greater diameter than the first circular groove 541, a third circular groove 543 outside of the second circular groove 542 and having a greater diameter than the second circular groove 542, a fourth circular groove 544 outside of the third circular groove 543 and having a greater diameter than the third circular groove 543, and a fifth circular groove 545 at an edge of the pad body 520 and having a greatest diameter.

In an implementation, the circular groove 540 may include the first to fifth circular grooves 541, or the number of circular grooves 540 may be variously changed. In an implementation, the first to fifth circular grooves 541 to 545 may be concentric.

In an implementation, the connection groove 560 may include a first connection groove 561 connecting the first circular groove 541 and the second circular groove 542 and having a linear shape, a second connection groove 562 connecting the second circular groove 542 and the third circular groove 543, having a linear shape, and being displaced from the first connection groove 561, a third connection groove 563 connecting the third circular groove 543 and the fourth circular groove 544, having a linear shape, and being displaced from the second connection groove 562 and a fourth connection groove 564 connecting the fourth circular groove 544 and the fifth circular groove 545, having a linear shape, and being displaced from the third connection groove 563.

In an implementation, the first and third connection grooves 561 and 563 may extend in a radial direction of the first circular groove 541 and the third circular groove 543. In an implementation, the second and fourth connection grooves 562 and 564 may extend along a line tangent to the second circular groove 542 and the fourth circular groove 544.

In an implementation, the plurality of first to fourth connection grooves 561 to 564 may be spaced apart from each other in a circumferential direction. In an implementation, the third connection groove 563 may be aligned with the extension line of the first connection line 561.

As described above, slurry may be spread evenly over an entire region of the CMP pad 500 through the circular groove 540 and the connection groove 560, and the slurry may not be unnecessarily excessively supplied. As described above, there is an effect of improving semiconductor productivity and reducing slurry due to the supply of improved slurry.

The drawings illustrate the circular groove and the connection groove as lines, but it is understood that the circular groove and the connecting groove may have a certain width (e.g., and depth, to accommodate slurry therein).

By way of summation and review, grooves having various patterns may be present in the CMP pad for a smooth supply of a slurry abrasive.

One or more embodiments may provide a CMP pad capable of improving a supply of slurry.

As set forth above, a CMP pad capable of improving a slurry supply and a chemical mechanical polishing apparatus having the same may be provided.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A chemical mechanical polishing (CMP) apparatus, comprising:

a rotating plate;

a CMP pad on an upper surface of the rotating plate;

a rotating body facing the rotating plate and bringing a wafer into contact with the CMP pad to press the wafer; and a slurry supply configured to supply slurry to the CMP pad, wherein the CMP pad includes:

a pad body having a circular plate shape;

a plurality of circular grooves on a bottom surface of the pad body, the plurality of circular grooves having a circular shape;

a plurality of connection grooves connecting the plurality of circular grooves, the plurality of connection grooves each having a linear shape, the plurality of circular grooves includes:

a first circular groove in a central portion of the pad body, a second circular groove having a greater diameter than that of the first circular groove, a third circular groove outside of the second circular groove, a fourth circular groove having a greater diameter than that of the third circular groove, and a fifth circular groove at an edge of the pad body, the plurality of connection grooves includes:

a first connection groove connecting the first circular groove and the second circular groove, a second connection groove connecting the second circular groove and the third circular groove, a third connection groove connecting the third circular groove and the fourth circular groove, and a fourth connection groove connecting the fourth circular groove and the fifth circular groove, at least one of the first to fourth connection grooves is a radial connection groove extending along a line radial to at least one of the first to fourth circular grooves, at least one other one of the first to fourth connection grooves is a tangential connection groove extending along a line tangential to at least one of the first to fourth circular grooves, the at least one radial connection groove is spaced apart from the at least one tangential connection groove in a radial direction by one of the circular grooves, and the first to fourth connection grooves alternate between being tangential connection grooves and radial connection grooves such that each tangential connection groove is radially adjacent to one of the radial connection grooves.

2. The CMP apparatus as claimed in claim 1, wherein the plurality of circular grooves are concentric.

3. The CMP apparatus as claimed in claim 1, wherein:

the first connection groove is a radial connection groove extending along a line radial to the first circular groove, the second connection groove is a tangential connection groove extending along a line tangential to the second circular groove, the third connection groove is a radial connection groove extending along a line radial to the third circular groove, and the fourth connection groove is a tangential connection groove extending along a line tangential to the fourth circular groove and is connected to the fifth circular groove.

4. A chemical mechanical polishing (CMP) pad, comprising:

a pad body having a circular plate shape;

a plurality of circular grooves on a bottom surface of the pad body, the plurality of circular grooves having a circular shape; and a plurality of connection grooves connecting the plurality of circular grooves, the plurality of connection grooves each having a linear shape, wherein:

the plurality of circular grooves includes:

a first circular groove in a central portion of the pad body, a second circular groove having a greater diameter than that of the first circular groove, a third circular groove outside of the second circular groove, a fourth circular groove having a greater diameter than that of the third circular groove, and a fifth circular groove at an edge of the pad body, the plurality of connection grooves includes:

a first connection groove connecting the first circular groove and the second circular groove, a second connection groove connecting the second circular groove and the third circular groove, a third connection groove connecting the third circular groove and the fourth circular groove, and a fourth connection groove connecting the fourth circular groove and the fifth circular groove, at least one of the first to fourth connection grooves is a radial connection groove extending along a line radial to at least one of the first to fourth circular grooves, at least one other one of the first to fourth connection grooves is a tangential connection groove extending along a line tangential to at least one of the first to fourth circular grooves, the at least one radial connection groove is spaced apart from the at least one tangential connection groove in a radial direction by one of the circular grooves, and the first to fourth connection grooves alternate between being tangential connection grooves and radial connection grooves such that each tangential connection groove is radially adjacent to one of the radial connection grooves.

5. The CMP pad as claimed in claim 4, wherein the plurality of circular grooves are concentric.

6. The CMP pad as claimed in claim 4, wherein:

the first connection groove is a radial connection groove extending along a line radial to the first circular groove, the second connection groove is a tangential connection groove extending along a line tangential to the second circular groove, the third connection groove is a radial connection groove extending along a line radial to the third circular groove, and the fourth connection groove is a tangential connection groove extending along a line tangential to the fourth circular groove and is connected to the fifth circular groove.

* * * * *